US005593158A

United States Patent [19]

Filice et al.

[11] Patent Number: 5,593,158

[45] Date of Patent: Jan. 14, 1997

[54] SHOCK ATTENUATING BALL BAT

[75] Inventors: Gary W. Filice, Moorpark; Dewey Chauvin, Simi Valley, both of Calif.

[73] Assignee: Jas D. Easton, Inc., Van Nuys, Calif.

[21] Appl. No.: 576,005

[22] Filed: Dec. 21, 1995

[51] Int. Cl.[6] ..... A63B 59/06

[52] U.S. Cl. ..... 473/520; 473/566

[58] Field of Search ..... 273/72 A, 72 R, 273/26 B

[56] References Cited

U.S. PATENT DOCUMENTS 5,303,917 4/1994 Uke ..... 273/72 R

*Primary Examiner*—Mark S. Graham
*Attorney, Agent, or Firm*—Roth & Goldman

[57] ABSTRACT

A shock attenuating hollow bat including a barrel having a proximal taper segment and a separate handle having a distal tapered segment providing an enlarged shape at the distal end of the handle, the tapered segment of the handle fitting within the proximal taper segment of the barrel, the relative sizes of the enlarged distal end of the handle and the interior of the barrel at its proximal end providing a mechanical interference preventing the barrel from sliding distally off the handle, the barrel and handle elements being joined by an elastomeric isolation union between the inner surface of the barrel taper segment and the outer surface of the handle taper segment to form an integral bat having reduced shock transmission to the hands of a batter in the event of an off-center hit.

19 Claims, 2 Drawing Sheets

SHOCK ATTENUATING BALL BAT

CROSS REFERENCE TO RELATED APPLICATIONS, IF ANY

None

BACKGROUND OF THE INVENTION AND PRIOR ART

1. Field of the Invention

The present invention relates generally to a ball bat for use in sports play. More specifically, this invention relates to a bat configuration which reduces shock, or "sting", transmitted to a player's hands, arising, for example, from an off-center hit.

2. Description of the Related Art

The game of baseball is engaged in by players of a range of age and skill. Different types or classes of play exist, for example hardball, softball (fast pitch and slow pitch), and Little League ball comprise some examples of the recognized types or levels of play. Common to all levels and one key element of the game, batting skill, requires repeated practice, drills, development of eye/hand coordination, and a bottom-line level of confidence while batting. For many batters, a key element to the development of confidence while batting involves the management of the shock and vibration imparted to the hands (sting) when the ball impacts the barrel of the bat.

The problem of shock or "sting" being transferred to a batter's hand from the impact occasioned by a ball bat striking a baseball is well known. This problem is most pronounced when the ball impacts the barrel of the bat at a location along its length which is off of the area comprising the center of percussion, or "sweet spot" of the bat. This situation is known as an "off-center" hit.

The location of impact of a ball on a bat may occur either inside of, (proximal towards the batter) the sweet spot, or outside (distal) of the sweet spot. As will be appreciated by those skilled in the art, in either case the considerable shock, or energy imparted to the batter's hands is a result of the impact location being off a location associated with a center of dynamic balance of velocity and weight (momentum) and stiffness distribution of the bat along its length at the time of impact of the ball. An imbalance in forces acting on the bat in the transfer of momentum to the ball on impact induces an undesirable pattern of flexure of the bat from an at-rest centerline, which is characterizable as a traveling shock wave through the bat, and/or as a translationally or rotationally applied force to the bat handle grip portion, which is felt as a sting in the batter's hands.

Consequently, for at least one of these reasons, which may be combined with other factors, a ball impact in the sweet spot is felt to be a "solid hit" as opposed to an off-center impact. This is true even though the energy imparted to the ball in absolute terms, particularly in the case of impact points distal of the sweet spot, is not necessarily correlated to the solid feel of the impact according to the batter's perception. As is well known, more or less of the kinetic energy of the bat swing may be imparted to the ball, depending on how much energy is diverted into rotation and flex of the bat, which diversion itself depends on the location of the impact relative to the sweet spot, but other factors such as bat speed and the relative angle of the ball trajectory with respect to the orientation of the bat surface at the point of impact, for example (assuming the same or identical bats are used) can have more affect on how much energy is imparted to the ball.

Since it has been recognized that the shock or sting imparted to the batter's hands by off-center hits decreases the batter's confidence, and may, over time, affect the batter's bottom line level of confidence, mitigation of the discomfort and reduction of the unnerving quality of off-center hits has been recognized as desirable by those concerned with the art. Accordingly, in an attempt to reduce the discomfort of off-center hits, players and equipment manufacturers have tried such expedients as padded gloves, cushioned grips, and employing shock mitigating bat configurations, including multi-piece constructions including isolating elements within the construction of the bat.

Those concerned with the art have recognized that known bats incorporating these features have drawbacks. For example, a large number of parts, and complex construction compared with a conventional hollow bat for example increases the cost of such bats and may lessen their reliability due to increased probability of materials or manufacturing defects. Accordingly, what is needed is a more simple, reliable and cost effective design which is effective in reducing the discomfort of off-center hits, by reducing the sudden deflection of the bat handle and the energy transferred to a batter's hands by forces acting through the handle grip during batting. It is to this end that the present invention is directed.

SUMMARY OF THE INVENTION

Accordingly, the present invention provides a shock attenuating hollow bat configuration adapted to reduce shock transmitted to the hands of a user resulting from an off-center hit. The bat includes a barrel having a proximal end and a distal end, and having an opening at the proximal end. The barrel has an inner surface. Also included is a separate handle having a proximal end and a distal end, and having an enlarged interference segment adjacent the distal end. The enlarged interference segment is configured so as to interfere with movement of the handle through the opening at the proximal end of the barrel. Further, an elastomeric isolation union is disposed between the inner surface of the barrel and an outer surface of the handle at the enlarged interference segment. This elastomeric isolation union allows relative movement between the barrel and the handle so as to reduce shock transmitted from said handle to the hands of a user in hitting a ball with the bat. This is particularly true in the case of an off-center hit.

In a more detailed aspect, Such a bat can include a barrel taper segment adjacent the proximal end of the barrel having an inner tapered surface. This barrel taper segment itself having a proximal and a distal end, and the barrel having a first inner diameter at the distal end of the barrel taper segment and a second inner diameter smaller than the first inner diameter at the proximal end of the barrel taper segment. In this case the handle has a handle taper segment forming the enlarged interference segment adjacent its distal end, having an outer tapered surface configured to fit within the inner tapered surface of the barrel taper segment of the barrel. The handle taper segment also having a proximal and a distal end, it has a first outer diameter at the distal end of the handle taper segment and a second diameter smaller than the first diameter at the proximal end of the handle taper segment. The handle taper segment is positioned within the barrel taper segment. In this case the elastomeric isolation union is disposed between the inner tapered surface of the barrel taper segment and the outer tapered surface of the handle taper segment.

In a further more detailed aspect, the isolation union is adhesively joined to the handle and the barrel and connects these two elements of the bat. By allowing, but resisting, relative movement (particularly relative flexure) between the barrel and the handle, and isolating the handle from the barrel, deflection of the handle from the at-rest central axis, and consequently, shock and vibratory energy transferred to the hands of the batter is lessened.

In another detailed aspect, the isolation union can be initially in a flowable plastic state when positioned between the handle and the barrel and itself have adhesive properties when cured, permanently joining the barrel and the handle when fully cured. Using such a flowable material to comprise the isolation union, the material can be applied to one or both elements (handle and barrel) and they can thereafter be relatively positioned as desired while the flowable material cures.

In a further more detailed aspect, the relative movement between the barrel and the handle allowed, and the degree of isolation of the two elements, can be selected. This is done by selecting the thickness of the material from which the isolation union is made, as well as the properties of this material. In manufacturing, the selected configuration is simply achieved by applying uncured elastomeric adhesive material to at least one of the tapered surfaces, positioning the handle taper segment within the barrel taper segment, adjusting the distance between the outer surface of the handle taper segment and the inner surface of the barrel taper segment by moving the barrel and handle in opposite directions with respect to one another to squeeze the elastomeric adhesive material therebetween, thereby spreading the material and insuring bonding contact between the isolation union and the surfaces, and holding the handle and barrel in position as the elastomeric adhesive material cures.

As can be appreciated, the bat of the invention attenuates the shock or sting associated with the impact of a hit, and particularly that of an off-center hit. Moreover, the bat is of a very simple and easily manufactured configuration having few parts. Furthermore, the bat configuration has been found capable of providing these advantages without appreciably affecting bat performance as compared with known bats otherwise comparable.

DETAILED DESCRIPTION OF THE PREFERRED EMBODIMENTS

Figure 1:
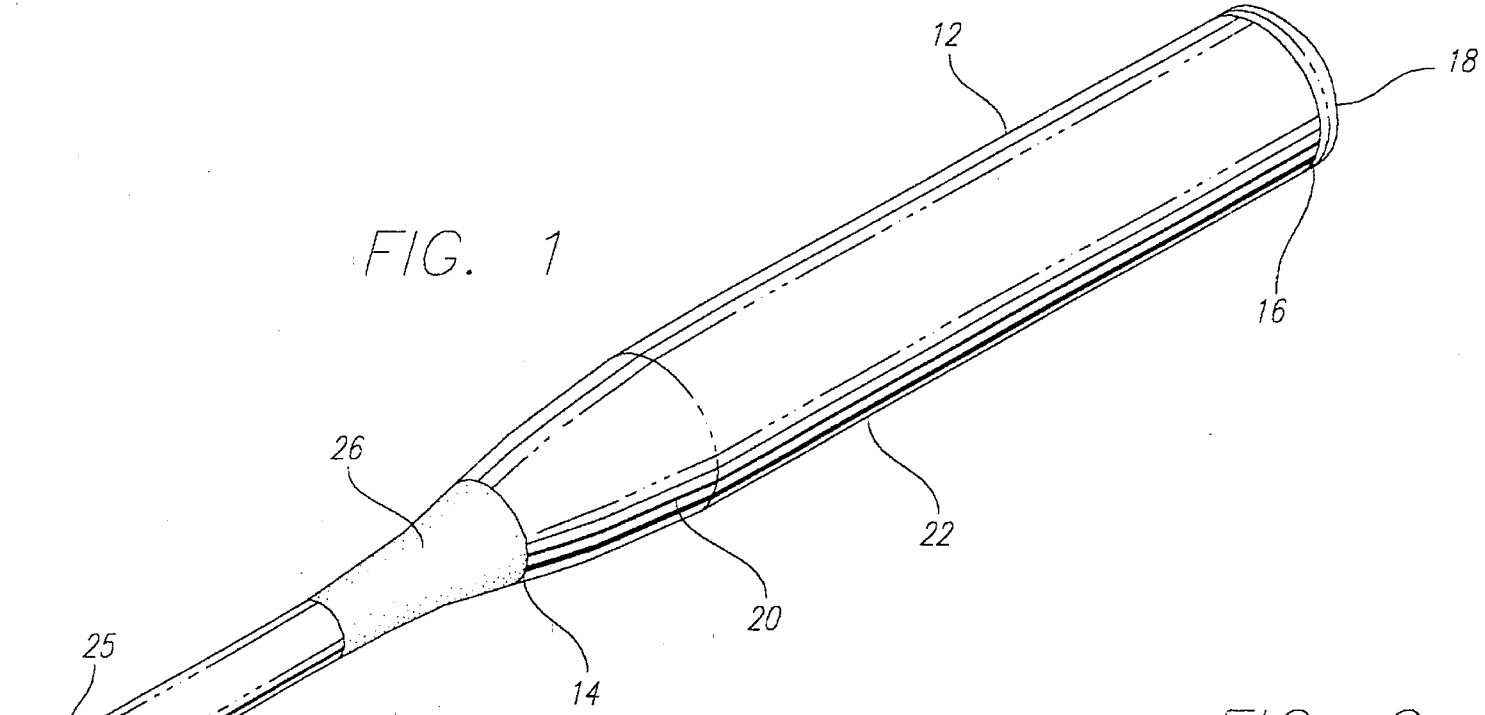
FIG. 1 is a perspective view of a ball bat according to the invention.

Referring to FIG. 1 of the drawings, which are provided by way of illustration, and not by way of limitation, a ball bat 10 of the invention comprises a barrel 12 formed of a metal such as aluminum alloy having a proximal end 14 and a distal end 16 closed by an end cap 18. As can be appreciated, the closure can be made by other means such as a roll over, as is known in the art, for example. The barrel incorporates a barrel taper segment 20 having a distal end 22 where the barrel transitions from a frustoconical configuration to a more generally cylindrical configuration, and a proximal end (which in the case of the illustrated embodiment corresponds with the proximal end of the barrel 14). As can be appreciated, the cylindrical configuration of the barrel shown can be modified to incorporate further taper. The bat further comprises a handle 24, also formed of a metal, having a proximal end 25 and a transition 26 which completes the barrel taper and provides a continuous smooth shape blending the handle and barrel into a single integral bat shape having a smooth outer contour. A knob 28 formed of any suitable material, for example an aluminum alloy, is permanently attached to the handle at the proximal end.

The barrel 12 and handle 24 elements of the bat can be formed of other materials as is known in the art. For example, a composite material might be employed including a fibrous material and a resilient resin as is known in the art. Also, the knob 28 alternatively could be unitary with the handle, depending on the size of the knob as will become apparent from the discussion below.

Figure 2:
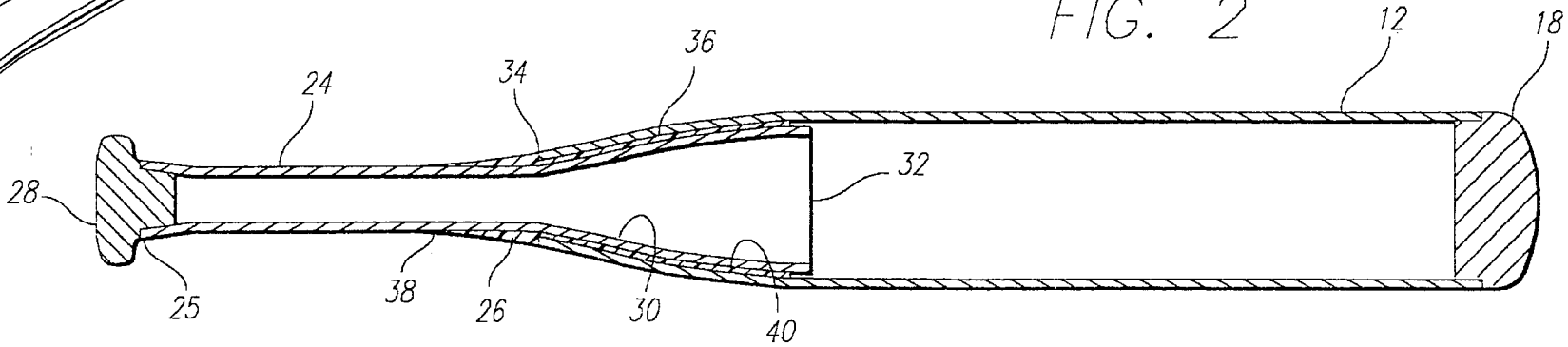
FIG. 2 is a sectional view of the ball bat of FIG. 1 taken along line 22 in FIG. 1.

Referring to FIG. 2, an enlarged interference segment of the handle comprising a tapered segment 30 is incorporated in the handle 24 adjacent a distal end 32 thereof. The enlarged interference segment can have another configuration, for example one or more radially extending projections or flanges (not shown) such as would prevent the handle from being drawn proximally from the barrel; and also a different compatible inner surface configuration for the inner surface of the barrel can also be employed. The guiding principles in providing the enlarged interference segment include the safety provided by preventing the barrel from sliding distally off the handle should one or more of the handle, barrel, or isolation union become detached from another, providing the desired isolation and flexural properties of the isolation union, and providing for optimal bonding between the barrel, handle, and isolation union elements.

Returning to the illustrated embodiment, the handle taper segment has a proximal end 34 where the handle material begins to be markedly flared to form the handle taper segment. The knob 28 is attached to the handle at the proximal end 25 by welding, or other connection means such as a threaded or pinned connection for example. The end cap 18 can be attached by means of adhesive, or by rolling over the end of a metal barrel segment slightly for example, or by threading, pinning, or other known means.

An isolation union 36 adhesively joins the handle 24 and barrel 12, holding them in proper alignment and spacing them one from another. The isolation union fills the space between the inner surface 38 of the barrel taper, and the outer surface 40 of the handle taper segment. The isolation union is formed of a castable urethane material, but as can be appreciated, can be formed of other materials more compliant than the material from which the barrel or handle are formed. As can also be appreciated, the location of the tapered or otherwise interfering portions of the bat and handle and the isolation union can be varied between the limits of the handle grip and the center of percussion (sweet spot) of the bat. As can further be appreciated, the isolation union 36 could comprise a separate element, itself adhesively bonded to both the outer surface 40 of the handle taper segment 30 and to the inner surface 38 of the barrel taper segment 20.

The modulus of elasticity of the isolation union is much less than that of the metal barrel 12 and metal handle 24, and the isolation union 36 performs both an isolation function in allowing relative movement between the elements and an adhesive function permanently attaching them together to form an integral bat. The properties of the isolation material can be selected to achieve a specific performance criteria, as discussed below.

In allowing relative movement between the barrel 12 and the handle 24, the isolation union 36 deforms, and in so doing converts kinetic energy that would otherwise be transferred to the batter's hands into heat subsequently lost to the surroundings. The bat 10 has, in effect, more tendency to flex at a single location, that of the isolation union, and less tendency at the handle to deflect or to rotate as the moment forces acting on the bat due to the unbalanced force application or rebound cannot be transferred across the isolation union to the extent that it acts as a hinge. Also, in some situations at least part of the energy transferred to the isolation union is subsequently transferred to the ball (not shown) through the barrel 12 on rebound of the elastomeric material forming the isolation union. Furthermore, the isolation union acts to attenuate vibration of the bat on rebound, converting vibratory kinetic energy to heat energy subsequently lost to the surroundings. In hitting then, for one or a combination of these reasons, the disclosed configuration acts in reducing shock/sting to the batter's hands in the bat of the invention. Moreover, while particularly effective in the case of an off-center hit, the shock mitigating action can also reduce discomfort associated with a solid (center of percussion) hit; for example by reducing deflection of the handle from the central axis of the bat still further.

In practical terms, the isolation union 36 in this configuration acts in a sense as a substitute for the soft tissue and bones of a batters hands, i.e. , the elastomeric isolation union deforms more, and the batter's hands less, in resisting forces acting on the bat. However, it has been found that in the aggregate, the amount of energy used in ways other than imparting an impulse to the ball appears to not be appreciably different than that associated with a conventional bat of generally the same type. Accordingly, performance of the bat in terms of distance of ball travel achieved is not appreciably diminished. This result is of great importance to players, as it allows reduced shock/sting felt but does not otherwise affect the batter's game.

Figures 3, 4:
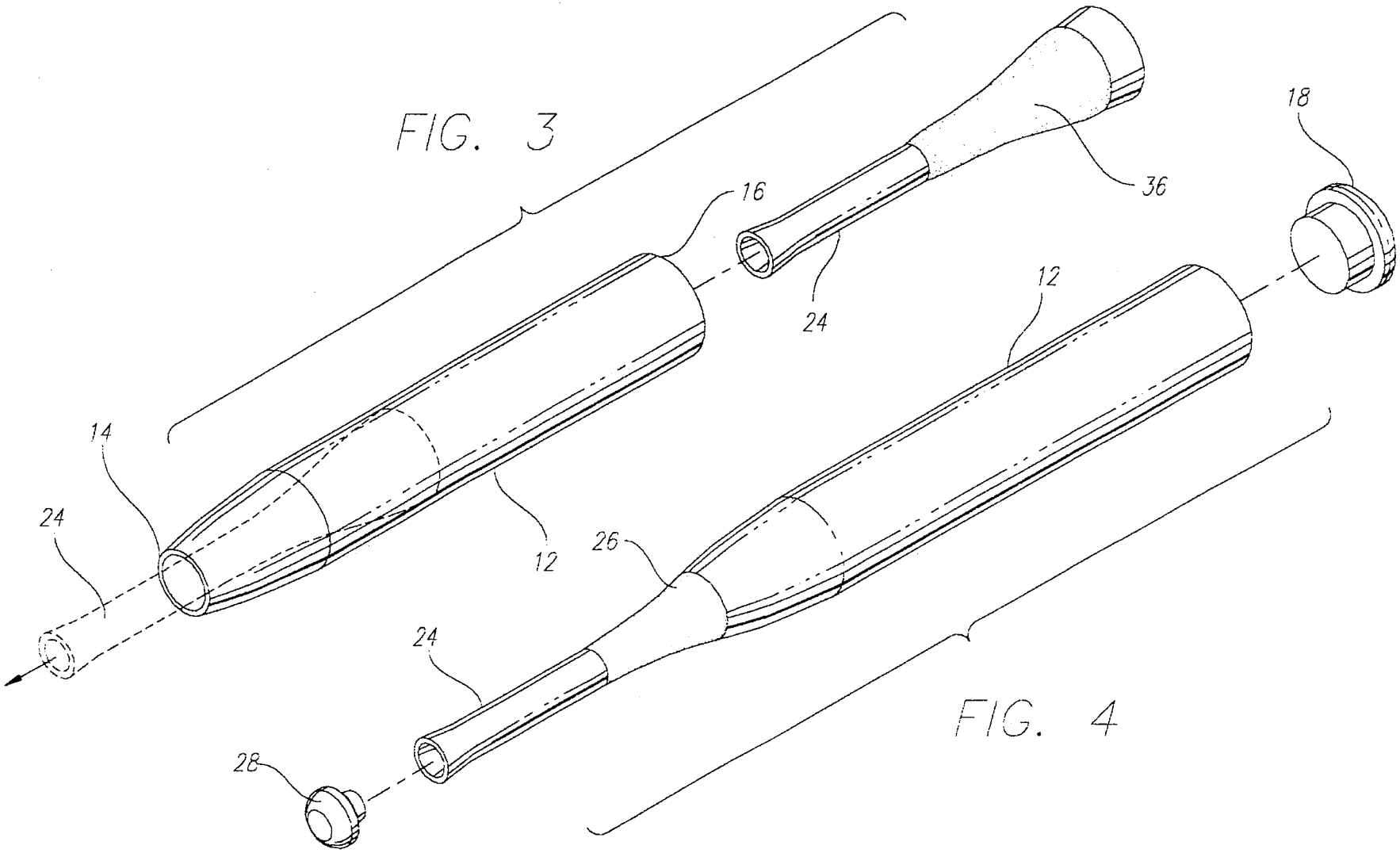
FIG. 3 is a perspective illustration of a barrel and a handle of a bat of the invention illustrating assembly of the ball bat.
FIG. 4 is a perspective view of the bat of FIG. 3 showing further steps in assembly thereof.

With reference now to FIGS. 3 and 4, the bat 10 of the invention is assembled according to a presently preferred method by applying an elastomeric adhesive material comprising the isolatión union 36 to the outer surface 40 of the handle taper segment 30 of the handle 24. Thereafter, the handle is inserted through the open distal end 16 of the barrel 12 towards the proximal end 14 of the barrel. When the handle has passed through the barrel and protrudes proximally of the proximal end 14 of the barrel, it is drawn outward and into alignment with the barrel so that the handle and barrel elements are then aligned on a common axis. The elastomeric adhesive material forming the isolation union is compressed and spread between the elements within the space between the outer surface 40 of the handle taper segment 30 and the inner surface 38 of the barrel taper segment 20 as the surfaces are drawn toward each other. Relative movement between the barrel and handle is stopped when the two surfaces are the desired distance apart. The elastomeric adhesive material is then allowed to cure.

As can be appreciated, more or less force applied in drawing the elements 12, 24 in opposite directions will force more or less of the flowable elastomeric adhesive material forming the isolation union 36 to extrude out from the proximal end 14 of the barrel 12 and will provide a more or less thick isolation union (and distance between the tapered surfaces 38, 40). Altering the thickness of the isolation union is one way to alter the performance characteristics of the bat in attenuating shock transmitted to the handle arising from off-center hits. As will be appreciated, different amounts of desired energy absorption will result in different thicknesses and/or different materials used to form the isolation union. The properties of the isolation material can be selected to offer a wide range of performance characteristics and comfort (shock and vibration isolation). The properties of the isolation material (e.g. modulus, adhesive strength, tear strength, resilience, and damping efficiency) will determine the requisite thickness. In one presently preferred embodiment where the barrel and handle are formed of aluminum alloy the isolation union will be approximately 0.125 inch thick, and the urethane material from which the union is made will have a hardness of approximately 40 shore A.

The excess elastomeric adhesive extruded from the proximal end 14 of the barrel 12 is smoothed to form a transition portion 26 of the isolation union to continue and complete the taper of the barrel taper segment 20 and blend smoothly into the handle 24. This gives a more pleasing shape and appearance, and furthermore by use of color pattern and/or surface treatment the non-continuous aspects of the construction of the bat can be de-emphasized.

In an alternative exemplary embodiment the handle 24 and barrel 12 can be held in place and uncured elastomeric material injected therebetween to form the isolation union 36. In a further alternative exemplary embodiment, a preformed and cured isolation union is placed on the handle and the handle is subsequently pulled or pressed through the opening at the proximal end 14 of the barrel. In doing so the transition portion 26 of the isolation union is elastically deformed until it emerges proximally from the barrel and snaps into place. As can be appreciated, this "snap fit" simplifies assembly.

After the handle 24 and barrel 12 have been joined as described, the end cap 18 is inserted into the distal end 16 of the barrel to provide permanent closure. The knob 28 is also thereafter attached to the proximal end 25 of the handle 24.

Persons skilled in the art will appreciate the advantages in manufacturing cost and product reliability associated with the bat of the invention in comparison with known bat designs directed to shock attenuation having numerous parts and more complex constructions.

Persons skilled in the art will also readily appreciate that various modifications can be made from the preferred embodiments of the invention disclosed herein and still be within the spirit and scope of the invention, and further that the scope of protection is intended to be defined only by the appended claims.

We claim:

1. A shock attenuating bat adapted to reduce shock transmitted to the hands of a user resulting from striking a ball with a bat, comprising:

a barrel having a proximal end and a distal end, having an opening at the proximal end, and an inner surface;

a handle having a proximal end and a distal end, having an enlarged interference segment having an outer surface, said enlarged interference segment being configured so as to interfere with movement of said handle through the opening at the proximal end of the barrel;

an elastomeric isolation union disposed between said inner surface of said barrel and said outer surface of said handle enlarged interference segment, separating said barrel from said handle, and, said elastomeric isolation union being the only connection between said handle and said barrel, said elastomeric isolation union allowing relative movement between said barrel and said handle so as to reduce shock transmitted from said handle to the hands of a user in hitting a ball with the bat.

2. The bat of claim 1, wherein said isolation union is adhesively joined to said handle and to said barrel.

3. The bat of claim 1, wherein the barrel is hollow and the proximal and distal ends of said barrel are initially open, and the handle is inserted through said hollow barrel in a direction from the distal end of said barrel toward the proximal end thereof, said proximal end of the handle protruding through the open proximal end of said barrel.

4. The bat of claim 1, wherein said elastomeric union is formed of elastomeric adhesive material initially in a flowable uncured state, the handle and barrel being held in desired relative positions while allowing said elastomeric adhesive material to cure.

5. The shock attenuating bat of claim 1, wherein the enlarged interference segment comprises a tapered surface and said inner surface of the barrel comprises a tapered surface.

6. A shock attenuating bat adapted to reduce shock transmitted to the hands of a user resulting from striking a ball with a bat, comprising:

a barrel having proximal and distal ends, having a barrel taper segment adjacent the proximal end thereof having an inner tapered surface, the barrel taper segment having a proximal end, and a distal end, said barrel having a first inner diameter at the distal end of the barrel taper segment and a second inner diameter smaller than said first inner diameter at said proximal end of the barrel taper segment;

a handle having proximal and distal ends, having a handle taper segment adjacent the distal end thereof having an outer tapered surface configured to fit within the inner tapered surface of the barrel taper segment, the handle taper segment having a distal end and a proximal end, said handle having a first outer diameter at the distal end of the handle taper segment and a second outer diameter smaller than said first outer diameter at said proximal end of the handle taper segment, said handle taper segment being positioned within said barrel taper segment;

an elastomeric isolation union disposed between said inner tapered surface of said barrel taper segment and said outer tapered surface of said handle taper segment, separating said barrel from said handle, and said elastomeric isolation union being the only connection between said handle and said barrel, said elastomeric isolation union allowing relative movement between said barrel and said handle so as to reduce shock transmitted from said handle to the hands of a user in hitting a ball with the bat.

7. The bat of claim 6, wherein said isolation union is adhesively joined to said handle and to said barrel.

8. The bat of claim 6, wherein the distance between the inner tapered surface of said barrel taper segment and the outer surface of said handle taper segment over a portion of the overlapping respective surfaces is consistent so as to provide a uniform thickness of isolation union over said portion of the overlapping respective surfaces between said barrel and said handle.

9. The bat of claim 6, wherein the barrel is hollow and the proximal and distal ends of said barrel are initially open, and the handle is inserted through said hollow barrel in a direction from the distal end of said barrel toward the proximal end thereof, said proximal end of the handle protruding through the open proximal end of said barrel.

10. The bat of claim 9, where the elastomeric union is disposed on at least one taper segment surface before the handle is inserted through the barrel, and the handle and the barrel are urged in opposite directions so as to compress the elastomeric union between said inner tapered surface of the barrel taper segment and the outer tapered surface of the handle taper segment.

11. The bat of claim 10, wherein said elastomeric union is formed of adhesive material initially in a flowable plastic uncured state, the handle and barrel being held in desired relative positions while allowing said elastomeric adhesive material to cure.

12. The bat of claim 9, further comprising an end cap disposed in and closing said distal end of the barrel.

13. The bat of claim 12, further comprising a knob integrally attached to said handle at the proximal end thereof after said handle is inserted through said barrel so as to have its proximal end protrude from said proximal end of said barrel.

14. A method for making a hollow barrel bat, comprising the steps of:

providing a hollow barrel having open proximal and distal ends, having a barrel taper segment adjacent said proximal end thereof having an inner tapered surface, the barrel taper segment having a proximal end and a distal end, said barrel having a first inner diameter at the distal end of the barrel taper segment and a second inner diameter smaller than said first inner diameter at said proximal end of the barrel taper segment;

providing a handle having proximal and distal ends, having a handle taper segment adjacent the distal end thereof having an outer tapered surface configured to fit within the tapered inner surface of the barrel taper segment, the handle taper segment having a distal end and a proximal end, said handle having a first outer diameter at the distal end of the handle taper segment and a second outer diameter smaller than said first outer diameter at said proximal end of the handle taper segment, said first outer diameter being greater than said second inner diameter of said barrel taper segment and said second outer diameter being less than said second inner diameter of said barrel taper segment;

providing an elastomeric isolation union adapted to be disposed between and adhere to said inner tapered surface of said barrel taper segment and said outer tapered surface of said handle taper segment, said elastomeric isolation union being adapted to allow relative flexure between said barrel and said handle so as to reduce shock transmitted from said handle to the hands of a user in connection with an off-center hit;

inserting said handle through said hollow barrel in a direction from the distal end of said barrel toward the proximal end thereof, said proximal end of the handle protruding through the open proximal end of said barrel;

positioning said handle taper segment within said barrel taper segment;

disposing said elastomeric union between said outer tapered surface of said handle taper segment and said inner tapered surface of said barrel taper segment.

15. The method of claim 14, further comprising the steps of:

providing an end cap; and affixing said end cap in said distal end of said barrel.

16. The method of claim 15, further comprising the steps of:

providing a knob; and affixing said knob integral with said handle at the proximal end thereof.

17. The method of claim 14, further comprising the step of:

adjusting the distance between the inner tapered surface of said barrel taper segment and the outer surface of said handle taper segment so as to provide a selected thickness of the isolation union between said barrel and said handle.

18. The method of claim 17, further comprising the steps of:

providing said elastomeric union in the form of adhesive material initially in a flowable plastic uncured state;

disposing said elastomeric union material on at least one of said taper surfaces;

holding said handle and said barrel in desired relative positions while allowing said elastomeric adhesive material to cure.

19. The method of claim 18, further comprising the steps of:

applying flowable elastomeric material to said handle just proximal of the joined barrel; and forming and smoothing said elastomeric material so as to provide a desired transition between said barrel and said handle.

* * * * *